US008387984B2

(12) United States Patent
Artsiely

(10) Patent No.: US 8,387,984 B2
(45) Date of Patent: Mar. 5, 2013

(54) MANIPULATIVE THREE-DIMENSIONAL PUZZLE

(75) Inventor: Eyal Artsiely, Arvot Hayarden (IL)

(73) Assignees: Bahry Uri Management Ltd., Tel Aviv (IL); E.O. Artsiely Agriculture and Product Development Ltd., M.P. Arvot Hayarden (IL); Arie Shpatz, Kiryat Ono (IL); Moshe Dolev, Udim (IL)

( * ) Notice: Subject to any disclaimer, the term of this patent is extended or adjusted under 35 U.S.C. 154(b) by 275 days.

(21) Appl. No.: 12/755,454

(22) Filed: Apr. 7, 2010

(65) Prior Publication Data

US 2011/0248443 A1 Oct. 13, 2011

(51) Int. Cl.
*A63F 9/08* (2006.01)

(52) U.S. Cl. ..... 273/153 S

(58) Field of Classification Search ..... 273/153 S, 273/153 R, 156
See application file for complete search history.

(56) References Cited

U.S. PATENT DOCUMENTS

| | | | | | |
|---|---|---|---|---|---|
| 476,980 | A * | 6/1892 | Cook | 273/153 S |
| 4,452,454 | A * | 6/1984 | Greene | 273/153 S |
| 4,484,744 | A * | 11/1984 | Gmunder | 273/153 S |
| 4,526,372 | A * | 7/1985 | Kikis | 273/153 S |
| 4,553,754 | A * | 11/1985 | Wiggs et al. | 273/153 S |
| 4,817,952 | A * | 4/1989 | Biro et al. | 273/153 S |
| 4,872,682 | A * | 10/1989 | Kuchimanchi et al. | 273/153 S |
| 4,889,340 | A * | 12/1989 | Greene | 273/153 S |
| 4,993,715 | A * | 2/1991 | Brooking | 273/153 S |
| 5,074,562 | A * | 12/1991 | Green | 273/153 S |
| 5,114,148 | A * | 5/1992 | Liu | 273/153 S |
| 5,242,166 | A * | 9/1993 | Wong | 273/153 S |
| 5,389,063 | A * | 2/1995 | Wu | 601/135 |
| 5,449,175 | A * | 9/1995 | Nagy et al. | 273/153 S |
| 5,452,895 | A * | 9/1995 | Ray | 273/153 S |
| 5,566,941 | A * | 10/1996 | Destics | 273/153 S |
| 5,836,584 | A * | 11/1998 | Chen | 273/153 S |
| 6,857,632 | B2 * | 2/2005 | Tanner | 273/153 S |
| 2003/0155709 | A1 * | 8/2003 | Han | 273/153 S |
| 2009/0096161 | A1 * | 4/2009 | Fedoseyev et al. | 273/153 S |

FOREIGN PATENT DOCUMENTS

| | | |
|---|---|---|
| CN | 201342234 | 11/2009 |
| EP | 0578621 | 1/1994 |
| GB | 2345643 | 7/2000 |
| WO | 84/02851 | 8/1984 |

OTHER PUBLICATIONS

PCT Search Report PCT/US2011/031487, Apr. 7, 2011.

* cited by examiner

*Primary Examiner* — Steven Wong
(74) *Attorney, Agent, or Firm* — Dekel Patent Ltd.; David Klein

(57) ABSTRACT

A manipulative three-dimensional puzzle including a shell member formed with a plurality of tracks including a first set of tracks and a second set of tracks, the first and second sets of tracks intersecting each other at a plurality of crossroads, the first and second sets of tracks together extending at least partially over a height, length and width of the shell member, and a plurality of puzzle pieces and a plurality of spacers movably positioned in the first and second sets of tracks, wherein for each track at least one spacer is between two puzzle pieces, and wherein moving one of the puzzle pieces in one of the tracks causes all the puzzle pieces and spacers in that track to move together along that track.

15 Claims, 5 Drawing Sheets

MANIPULATIVE THREE-DIMENSIONAL PUZZLE

FIELD OF THE INVENTION

The present invention relates generally to three-dimensional rearrangement puzzles, and particularly to such a puzzle with pieces that move on tracks.

BACKGROUND OF THE INVENTION

As is well known in the art, Ernö Rubik created a puzzle shaped as a cube, which is subdivided into 27 smaller cubes arranged in rows, columns, and layers in a 3×3×3 pattern. Any face of the large cube may be rotated by 90°, 180°, and 270° and so forth, to form different configurations. The parts are held together by a series of axles, extensions and channels.

U.S. Pat. No. 4,452,454 to Greene describes a manipulative game. It has a substantially spherical support member which has a plurality of square members that can be manipulated about three different tracks carried on the support member. At the junction of two tracks, the squares can be shifted from one particular track to another.

SUMMARY OF THE INVENTION

The present invention seeks to provide an improved three-dimensional rearrangement puzzle with pieces that move on tracks, as is described more in detail hereinbelow. In the present invention, There is thus provided in accordance with an embodiment of the present invention a manipulative three-dimensional puzzle including a shell member formed with a plurality of tracks including a first set of tracks and a second set of tracks, the first and second sets of tracks intersecting each other at a plurality of crossroads, the first and second sets of tracks together extending at least partially over a height, length and width of the shell member, and a plurality of puzzle pieces and a plurality of spacers movably positioned in the first and second sets of tracks, wherein for each track at least one spacer is between two puzzle pieces, and wherein moving one of the puzzle pieces in one of the tracks causes all the puzzle pieces and spacers in that track to move together along that track.

By "a first set of tracks" and "a second set of tracks" it is meant one or more first sets of tracks and one or more second sets of tracks.

In accordance with an embodiment of the present invention the first set of tracks are generally parallel to one another and the second set of tracks are generally parallel to one another.

In accordance with an embodiment of the present invention each set of tracks forms a continuous periphery about the shell member, and wherein moving one of the puzzle pieces in one of the tracks causes all the puzzle pieces and spacers in that track to move together along that track around the periphery of the shell member.

In accordance with an embodiment of the present invention the first and second sets of tracks are generally perpendicular to each other.

In accordance with an embodiment of the present invention the shell member includes a plurality of guide elements extending outwards therefrom, wherein gaps separate the guide elements from one another, the gaps forming the tracks in which the puzzle pieces and the spacers move.

In accordance with an embodiment of the present invention the each guide element includes a top portion extending from a base portion which extends outwards from the shell member, the top portion being larger in area than the base portion.

In accordance with an embodiment of the present invention each of the puzzle pieces includes an external top portion that extends from a pillar portion, wherein the pillar portion travels in the tracks.

In accordance with an embodiment of the present invention each of the puzzle pieces includes an external top portion that extends from a pillar portion, wherein the pillar portion travels in the tracks, and wherein the external top portion extends over adjacent top portions of each guide element, and wherein each spacer is disposed below the top portions of each guide element between adjacent base portions.

In accordance with an embodiment of the present invention each of the puzzle pieces is aligned at each of the crossroads with a tenon and a socket arrangement formed in the puzzle piece and the crossroad.

In accordance with an embodiment of the present invention the shell member includes first and second end cap members positioned at end faces of first and second corner members, respectively.

In accordance with an embodiment of the present invention the shell member further includes at least one longitudinal body member placed between the first and second corner members.

In accordance with an embodiment of the present invention the first and second sets of tracks are not perpendicular to each other.

In accordance with an embodiment of the present invention at least some of the puzzle pieces are differently colored, and/or differently shaped and/or have different indicia.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
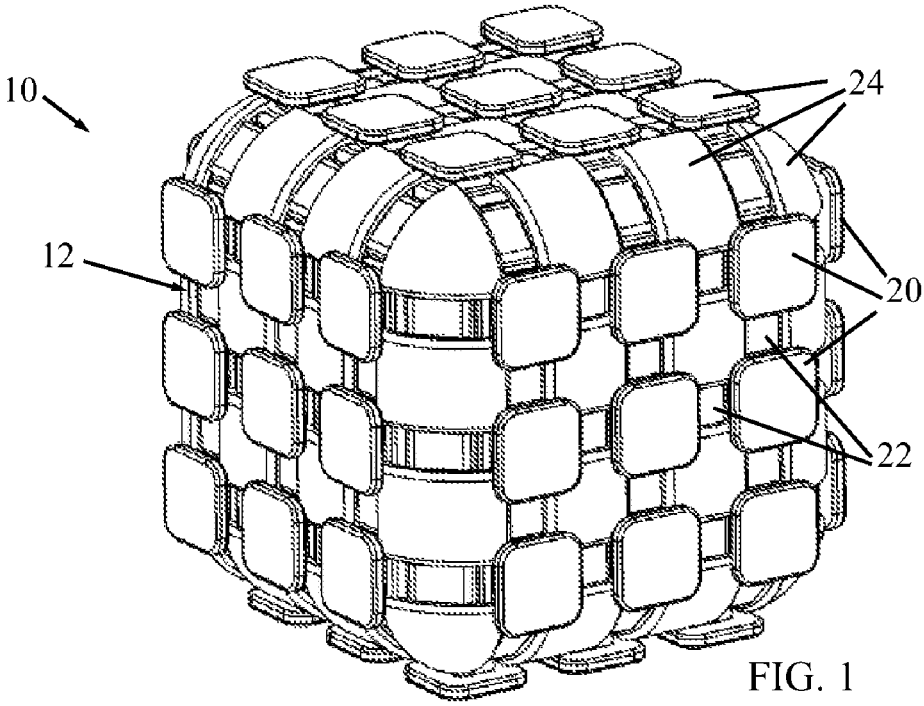
FIG. 1 is a simplified pictorial illustration of a puzzle including puzzle pieces and spacers that move in tracks, constructed and operative in accordance with an embodiment of the present invention.
Figure 2:
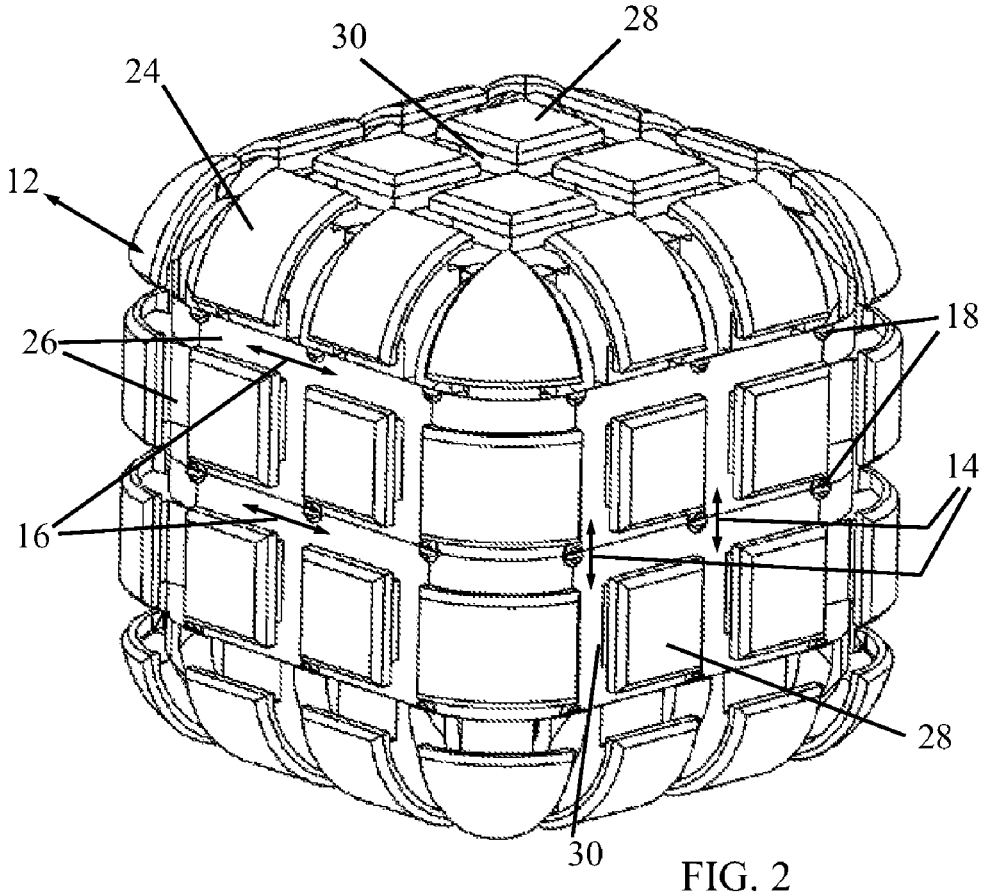
FIG. 2 is a simplified pictorial illustration of the puzzle of FIG. 1, without the puzzle pieces and spacers, showing tracks defined in a shell member, in accordance with an embodiment of the present invention.
Figure 3:
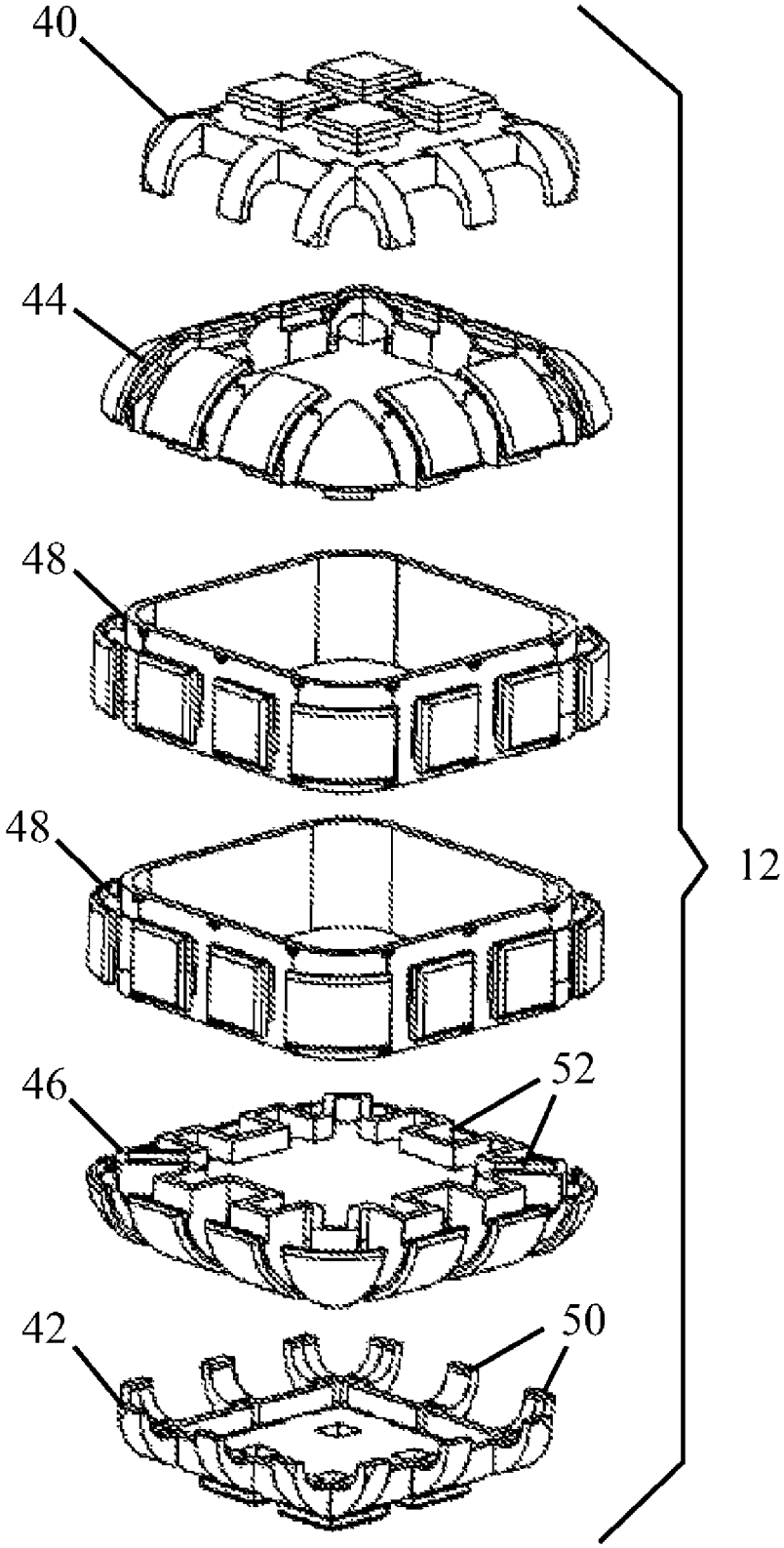
FIG. 3 is a simplified exploded illustration of the shell member.

Reference is now made to FIGS. 1-3, which illustrate a puzzle 10, constructed and operative in accordance with a non-limiting embodiment of the present invention.

Puzzle 10 includes a shell member 12 formed with a plurality of tracks (seen best in FIG. 2) including a first set of tracks 14 (longitudinal tracks in the drawings) and a second set of tracks 16 (latitudinal tracks in the drawings). The first and second sets of tracks 14 and 16 intersect each other at a plurality of crossroads 18.

A plurality of puzzle pieces 20 and a plurality of spacers 22 (FIG. 1) are movably positioned in the first and second sets of tracks 14 and 16. For each track, there is at least one spacer 22 positioned between two puzzle pieces 20. Moving one of the puzzle pieces 20 in one of the tracks 14 or 16 causes all the puzzle pieces 20 and spacers 22 in that track to move together along that track. As seen in the drawings, the first and second sets of tracks 14 and 16 together extend at least partially over a height, length and width of shell member 12, thereby forming a three-dimensional puzzle.

Figure 9:
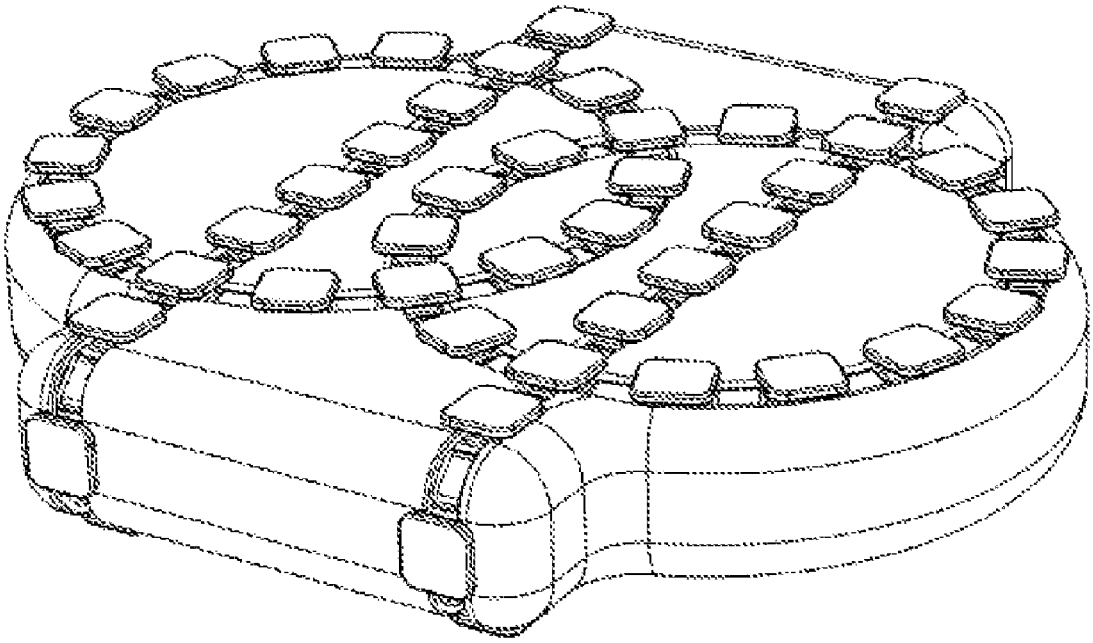
FIG. 9 is a simplified pictorial illustration of a puzzle including puzzle pieces and spacers that move in tracks, constructed and operative in accordance with another embodiment of the present invention.

In accordance with a non-limiting embodiment of the present invention (the illustrated embodiment in FIGS. 1-3), the first set of tracks 14 are generally parallel to one another and the second set of tracks 16 are generally parallel to one another. The first and second sets of tracks 14 and 16 are generally perpendicular to each other. (FIG. 9 shows an embodiment wherein the first and second sets of tracks are not perpendicular to each other.)

In the embodiment of FIGS. 1-3, each set of tracks 14 and 16 forms a continuous periphery about the shell member 12. Accordingly, moving one of the puzzle pieces 20 in one of the tracks causes all the puzzle pieces 20 and spacers 22 in that track to move together along that track around the periphery of the shell member 12.

Reference is now made particularly to FIG. 2 for the description of the structure of the tracks. In accordance with an embodiment of the present invention, shell member 12 includes a plurality of guide elements 24 extending outwards therefrom. Gaps 26 separate guide elements 24 from one another and these gaps 26 form the tracks in which the puzzle pieces and the spacers move.

Figure 4:
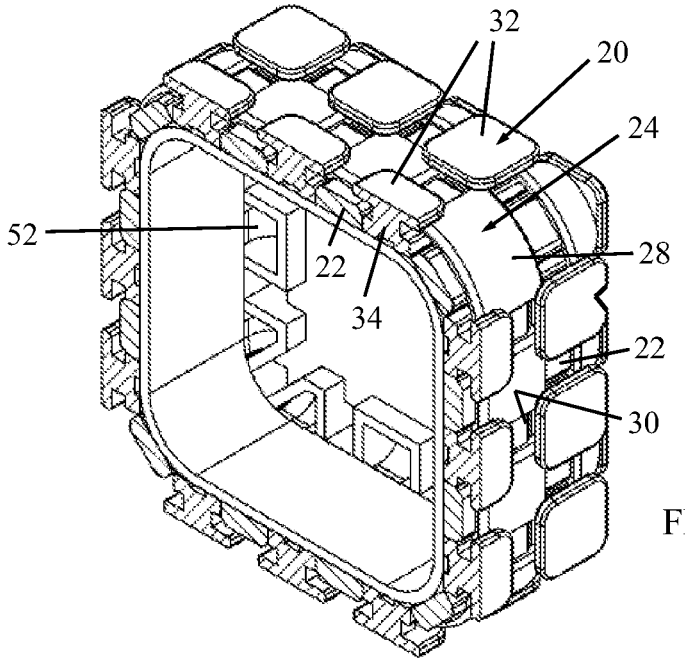
FIG. 4 is a simplified, cutaway pictorial illustration of part of the shell member.
Figure 5:
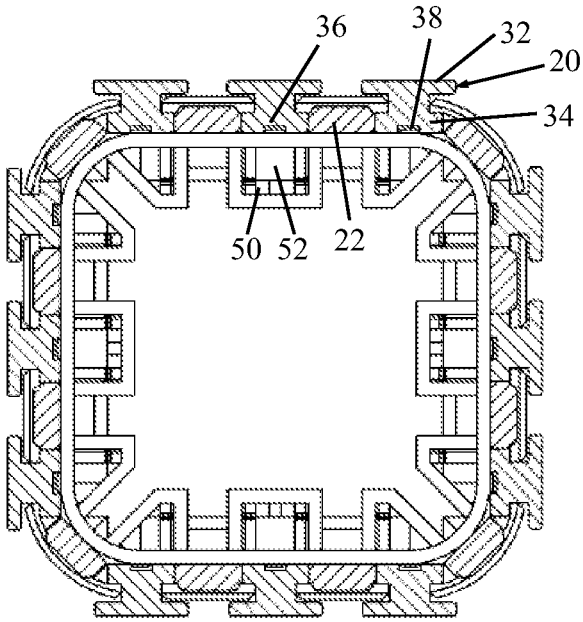
FIG. 5 is a simplified, sectional illustration of part of the shell member.
Figure 7:
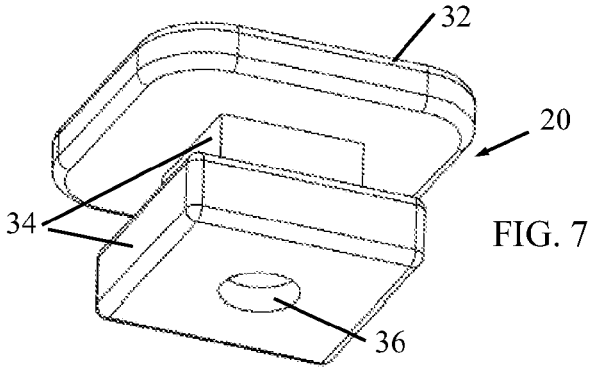
FIG. 7 is a simplified pictorial illustration of one of the puzzle pieces.
Figure 8:
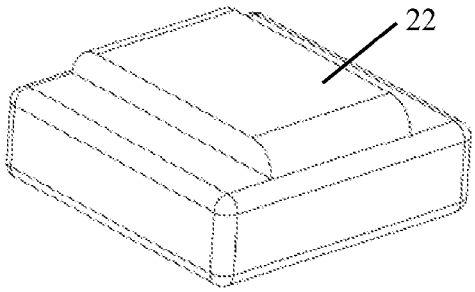
FIG. 8 is a simplified pictorial illustration of one of the spacers.

In the illustrated embodiment, each guide element 24 includes a top portion 28 extending from a base portion 30 which extends outwards from shell member 12. The top portion 28 is larger in area than the base portion 30. As seen clearly in FIGS. 4, 5 and 7, each of the puzzle pieces 20 includes an external top portion 32 that extends from a pillar portion 34. As seen clearly in FIGS. 4 and 5, it is the pillar portion 34 that travels in the tracks. The external top portion 32 extends over adjacent top portions 28 of each guide element 24. In contrast, each spacer 22 is disposed below the top portions 28 of each guide element 24 between adjacent base portions 30.

Alternatively, the puzzle pieces 20 can be fashioned in other shapes. For example, the puzzle pieces can be made without the external top portion 32. It is further noted that the pillar portion 34 can be of various shapes. The illustrated pillar portion 34 has a wider base but this also can be shaped in other ways.

In accordance with an embodiment of the present invention, each of the puzzle pieces 20 is aligned at each of the crossroads 18 with a tenon and a socket arrangement formed in the puzzle piece and the crossroad. In the illustrated embodiment, as seen clearly in FIGS. 5 and 7, the puzzle piece 20 is formed with a socket 36 (e.g., small depression) and shell member 12 is formed with a tenon 38 (e.g., small protrusion—seen in FIG. 5) at crossroad 18. When the puzzle piece 20 is moved to the crossroad 18, the tenon 38 "clicks" into socket 36, so as to give a positive feel to the user that the puzzle piece 20 is correctly positioned at the crossroad 18. (Of course, alternatively, the puzzle piece may be formed with the tenon and the shell member may be formed with the socket.)

Reference is now made particularly to FIG. 3. Shell member 12 includes first and second end cap members 40 and 42 positioned at end faces of first and second corner members 44 and 46, respectively. One or more longitudinal body members 48 are placed between the first and second corner members 44 and 46. Note that the corner and edge guide elements 24 of first and second corner members 44 and 46 (and of longitudinal body members 48) are rounded to form round corners and edges of the finished three-dimensional structure. The different parts of shell member 12 may be secured together in any suitable manner, such as but not limited to, interlocking tenons 50 and sockets 52 (seen best in FIGS. 3, 4 and 5).

Figure 6:
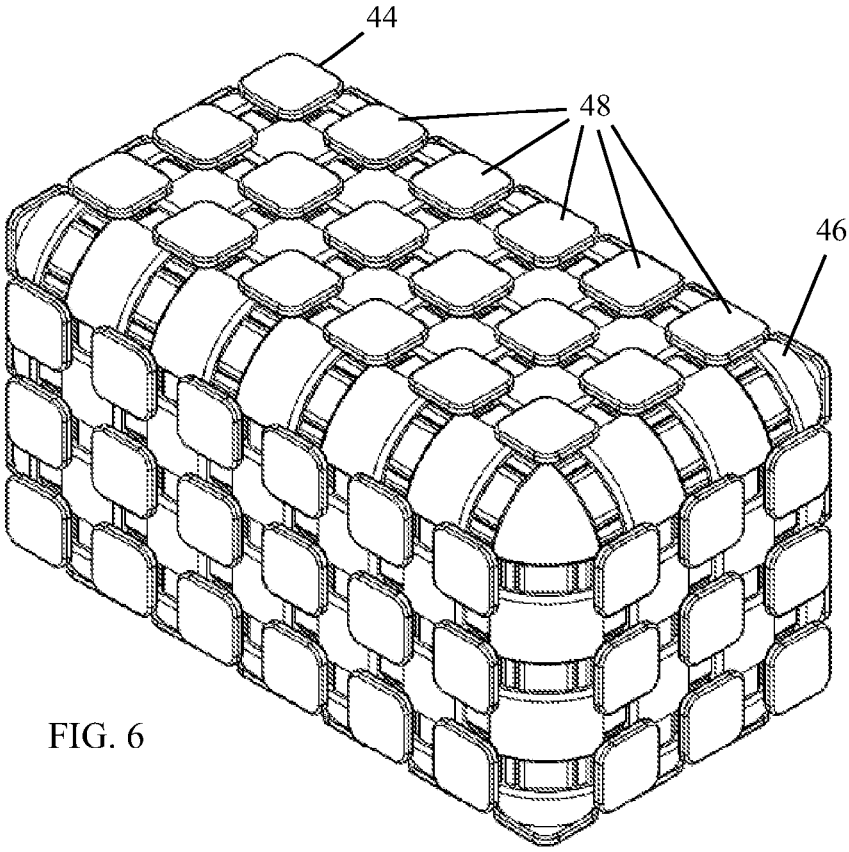
FIG. 6 is a simplified pictorial illustration of the puzzle extended into an oblong shape, in accordance with a non-limiting embodiment of the present invention.

As seen in FIG. 6, the three-dimensional structure can be made of a limitless length (box shape) by adding more and more longitudinal body members 48 are placed between the first and second corner members 44 and 46.

At least some of the puzzle pieces can be differently colored (red, green blue, etc. or combinations of colors), and/or differently shaped (e.g., circular, oval, square [with rounded or sharp corners], triangular, animal shapes, irregular shapes, etc.) and/or have different indicia (e.g., numbers, letters, words, etc.).

The puzzle can be rearranged randomly, with the object being to restore the puzzle pieces to their exact original positions. This may form a pattern of colors, or a picture (like a jigsaw puzzle) or many other arrangements.

In accordance with an embodiment of the present invention, the puzzle can be a "virtual" puzzle, that is, instead of physical pieces, the parts of the puzzle can be displayed visually as a computer puzzle and manipulated by a user on the computer screen. The user can enter commands to a computer (e.g., PC, personal communication device, cell phone, etc.) which interprets the commands to move the puzzle pieces. Alternatively or additionally, codes (e.g., letters or numbers or both) can be assigned for each possible position of the puzzle pieces and these codes can be used to move the pieces by suitable commands to the computer. Alternatively or additionally, the physical puzzle can transmit the current status of the puzzle pieces, wired (e.g., USB or any other connection) or wireless (e.g., BLUETOOTH, infrared, RF, etc.) to a processor for displaying as a virtual puzzle. This may be accomplished, for example, by providing the puzzle pieces with sensors (e.g., accelerometers) that sense the spatial 3D orientation of the puzzle piece, wherein the data sensed by the sensors is transmitted by a transmitter to the processor, processed and interpreted as the spatial 3D orientation of the puzzle piece. The user can interrogate the computer for ways to solve the puzzle. The computer knows the positions of the pieces and can offer different possible moves to the user.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A manipulative three-dimensional puzzle comprising:

a shell member formed with a plurality of tracks comprising a first set of tracks and a second set of tracks, the first and second sets of tracks intersecting each other at a plurality of crossroads, the first and second sets of tracks together extending at least partially over a height, length and width of said shell member; and a plurality of puzzle pieces and a plurality of spacers movably positioned in said first and second sets of tracks, wherein for each track at least one spacer is between two puzzle pieces, and wherein moving one of the puzzle pieces in one of the tracks causes all the puzzle pieces and spacers in that track to move together along that track, and wherein said spacers are shaped differently than said puzzle pieces;

wherein said shell member comprises a plurality of guide elements extending outwards therefrom, wherein gaps separate said guide elements from one another, said gaps forming the tracks in which said puzzle pieces and said spacers move;

wherein said each guide element comprises a top portion extending from a base portion which extends outwards from said shell member, said top portion being larger in area than said base portion; and wherein each of said puzzle pieces comprises an external top portion that extends from a pillar portion, wherein the pillar portion travels in the tracks, and wherein the external top portion extends over adjacent top portions of each guide element, and wherein each spacer is disposed below the top portions of each guide element between adjacent base portions.

2. The puzzle according to claim 1, wherein said first set of tracks are generally parallel to one another and said second set of tracks are generally parallel to one another.

3. The puzzle according to claim 1, wherein each set of tracks forms a continuous periphery about said shell member, and wherein moving one of the puzzle pieces in one of the tracks causes all the puzzle pieces and spacers in that track to move together along that track around the periphery of said shell member.

4. The puzzle according to claim 1, wherein said first and second sets of tracks are generally perpendicular to each other.

5. The puzzle according to claim 1, wherein each of said puzzle pieces comprises an external top portion that extends from a pillar portion, wherein the pillar portion travels in the tracks.

6. The puzzle according to claim 1, wherein each of said puzzle pieces is aligned at each of said crossroads with a tenon and a socket arrangement formed in the puzzle piece and the crossroad.

7. The puzzle according to claim 1, wherein said shell member comprises first and second end cap members positioned at end faces of first and second corner members, respectively.

8. The puzzle according to claim 7, wherein said shell member further comprises at least one longitudinal body member placed between said first and second corner members.

9. The puzzle according to claim 1, wherein said first and second sets of tracks are not perpendicular to each other.

10. The puzzle according to claim 1, wherein at least some of said puzzle pieces are differently colored.

11. The puzzle according to claim 1, wherein at least some of said puzzle pieces are differently shaped.

12. The puzzle according to claim 1, wherein at least some of said puzzle pieces have different indicia.

13. The puzzle according to claim 1, wherein said puzzle has a virtual form for displaying and manipulating on a display device.

14. The puzzle according to claim 1, wherein each of said puzzle pieces comprises a sensor that senses a spatial 3D orientation of the puzzle piece, and further comprising a transmitter operative to transmit data sensed by said sensors for displaying as a virtual puzzle.

15. The puzzle according to claim 13, wherein a code is assigned for a position of said puzzle pieces, wherein said puzzle pieces are moved in accordance with said code.

* * * * *